US005392857A

United States Patent [19]

Behrmann

[11] Patent Number: 5,392,857

[45] Date of Patent: Feb. 28, 1995

[54] APPARATUS AND METHOD FOR DETERMINING AN OPTIMUM PHASE ANGLE FOR PHASED CHARGES IN A PERFORATING GUN TO MAXIMIZE DISTANCES BETWEEN PERFORATIONS IN A FORMATION

[75] Inventor: Lawrence A. Behrmann, Houston, Tex.

[73] Assignee: Schlumberger Technology Corporation, Houston, Tex.

[21] Appl. No.: 103,507

[22] Filed: Aug. 6, 1993

[51] Int. Cl.[6] ..... E21B 43/117

[52] U.S. Cl. ..... 166/297; 175/4.6; 166/55.1; 102/310

[58] Field of Search ..... 175/4.6; 166/55.1, 297; 102/310, 320; 89/1.15

[56] References Cited

U.S. PATENT DOCUMENTS 4,726,431 2/1988 Oestreich et al. ..... 175/4.6

4,844,170 7/1989 Gill ..... 175/4.6 X 4,960,171 10/1990 Parrott et al. ..... 175/4.6 X 5,054,564 10/1991 Oestreich et al. ..... 175/4.6

*Primary Examiner*—William P. Neuder

*Attorney, Agent, or Firm*—Henry N. Garrana; John H. Bouchard

[57] ABSTRACT

A novel method utilizing a new mathematical formulation for determining an optimum phase angle for phasing shaped charges in a perforating gun allows a novel perforating apparatus to be designed which phases the shaped charges by an angle equal to the optimum phase angle. Therefore, when the shaped charges detonate and a plurality of perforations are produced in a formation traversed by the wellbore, since the optimum phase angle is used to phase the charges in the perforating gun, the distances between adjacent perforations in the formation are maximized. Since such distances are maximized, the liklihood that a bridge between adjacent perforations will fail is substantially reduced.

16 Claims, 3 Drawing Sheets

FIG. 5
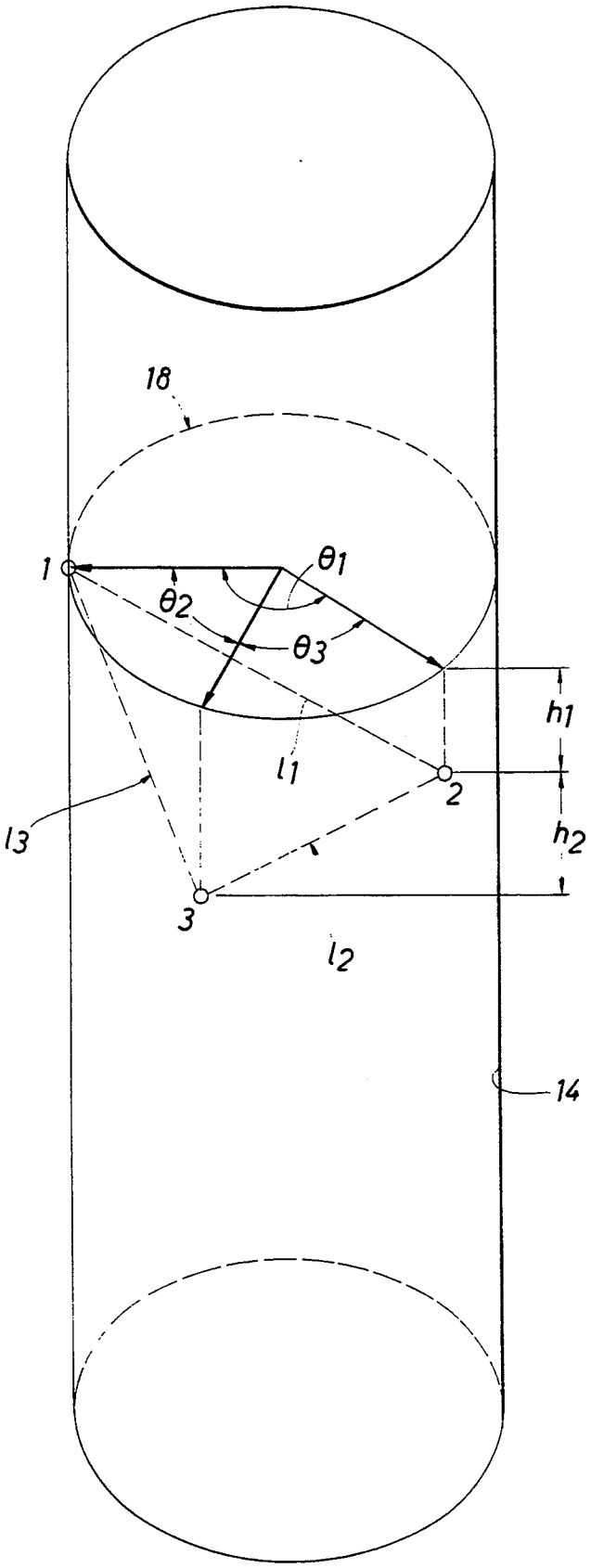
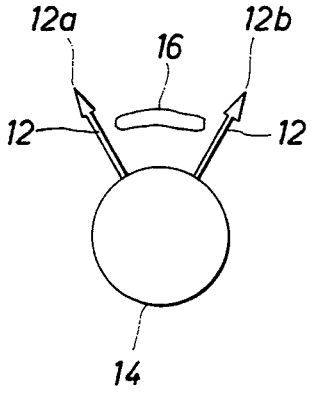
FIG. 4a

APPARATUS AND METHOD FOR DETERMINING AN OPTIMUM PHASE ANGLE FOR PHASED CHARGES IN A PERFORATING GUN TO MAXIMIZE DISTANCES BETWEEN PERFORATIONS IN A FORMATION

BACKGROUND OF THE INVENTION

The subject matter of the present invention relates to a perforating apparatus adapted to be disposed in a wellbore including phased shaped charges, the charges being phased in particular manner such that the distances between the perforations in a formation traversed by the wellbore produced by the phased charges are maximized, the maximized distance between two adjacent perforations preventing sand from one perforation from spilling over into the other perforation.

When a perforating gun having phased shaped charges is disposed in a wellbore and detonated, a plurality of perforations are produced in a formation traversed by the wellbore. A bridge is formed between adjacent perforations in the formation. If the bridge fails, disaggregated sand will be produced through the perforations resulting in reduced hydrocarbon production and, potentially, a complete failure of the well. Therefore, the charges in the perforating gun should be carefully phased for the purpose of preventing, to the maximum extent possible, any such bridge from failing between the adjacent perforations in the formation. In order to prevent the bridge between adjacent perforations from failing, the charges in the perforating gun should be correctly phased. In order to correctly phase the charges in the perforating gun, an optimum phase angle must first be determined; and, when the perforating gun is designed, the charges in the perforating gun must be phased by an angle equal to the optimum phase angle.

SUMMARY OF THE INVENTION

Accordingly, it is a primary object of the present invention to provide a perforating gun adapted to be disposed in a wellbore including a plurality of phased shaped charges adapted for producing a corresponding plurality of perforations in a formation traversed by the wellbore, the phasing of the shaped charges being carefully selected for the purpose of maximizing the distances between adjacent perforations in the formation thereby preventing a bridge from failing between the adjacent perforations.

It is a further object of the present invention to provide a perforating gun adapted to be disposed in a wellbore including a plurality of phased shaped charges having a given shot density adapted for producing a corresponding plurality of perforations in a formation traversed by the wellbore, the phasing of the shaped charges being carefully selected for the purpose of maximizing the distances between adjacent perforations in the formation thereby preventing a bridge from failing between the adjacent perforations while simultaneously maintaining constant the shot density associated with the phased shaped charges for a given radius of the wellbore.

It is a further object of the present invention to provide a perforating gun adapted to be disposed in a wellbore including a plurality of phased shaped charges having a given shot density adapted for producing a corresponding plurality of perforations in a formation traversed by the wellbore, the phasing of the shaped charges being carefully selected for the purpose of maximizing the distances between adjacent perforations in the formation thereby preventing a bridge from failing between the adjacent perforations while simultaneously maintaining constant the shot density associated with the phased shaped charges for a given radius of the wellbore, the distances being maximized when a first distance between one set of adjacent perforations is approximately equal to a second distance between another set of adjacent perforations and a third distance between a third set of adjacent perforations is greater than the first distance or the second distance.

It is a further object of the present invention to provide a method for determining an optimum phase angle associated with the phasing of shaped charges in a perforating gun adapted to be disposed in a wellbore without also changing the shot density of such charges, the shaped charges adapted for producing perforations in a formation traversed by the wellbore, the phase angle being optimum when the distances between adjacent ones of the perforations in the formation are maximized.

It is a further object of the present invention to provide a method for determining an optimum phase angle associated with the phasing of shaped charges in a perforating gun adapted to be disposed in a wellbore without also changing the shot density of such charges, the shaped charges adapted for producing perforations in a formation traversed by the wellbore, the phase angle being optimum when the distances between adjacent ones of the perforations in the formation are maximized, the distances being maximized when a first distance between one set of adjacent perforations is approximately equal to a second distance between another set of adjacent perforations and a third distance between a third set of adjacent perforations is greater than the first distance or the second distance.

In accordance with these and other objects of the present invention, a perforating gun adapted to be disposed in a wellbore includes shaped charges, the charges being phased. An optimum phase angle is first determined, and the charges are phased in accordance with the optimum phase angle. Therefore, when the charges detonate, a plurality of perforations are produced in a formation traversed by the wellbore. Because the optimum phase angle is used to phase the charges in the perforating gun, the distances between adjacent perforations in the formation are maximized. Since such distances are maximized, the liklihood that a bridge, between adjacent perforations in the formation, will fail is substantially reduced. Failure of this bridge would produce disaggregated sand; and the disaggregated sand would be produced through the perforations resulting in reduced hydrocarbon production and potentially complete failure of the well. However, if the distance between adjacent perforations is maximized, a structurally stronger bridge between the perforations is formed. This stronger bridge will thus be able to support larger in situ stresses which will allow greater depletion of the reservoir with lower reservoir pressure before failure of the bridge.

The optimum phase angle is determined as follows. Select three perforations in the formation and join the three perforations at their apex by drawing imaginary lines interconnecting the three perforations (see FIG. 5) to form a triangle having three sides, side "$1_1$" also known as 'side-1', side "$1_2$" also known as 'side-2', and side "$1_3$" also known as 'side-3'. Use a mathematical formulation to establish a table having several columns: shots per foot (shot density), phase angle, side $1_1$, side $1_2$, and side $1_3$. In the table, locate a 'particular phase angle' having a side-1, side-2, and side-3 which satifies the following relationship: two sides of the triangle are equal to each other and the third side is greater than either of the other two sides (e.g.-$1_1=1_2$, but $1_3>1_2$ and $1_3>1_1$). The 'particular phase angle' is the optimum phase angle which should be used for phasing the charges in the perforation gun. The mathematical formulation used to establish the table is set forth below, for a given shot density in shots/foot and wellbore radius (r):

$$1_1=[(\text{theta}_1 r)^2+h_1^2]^{\frac{1}{2}}$$

$$1_2=[(\text{theta}_3 r)^2+h_2^2]^{\frac{1}{2}},$$

where $\text{theta}_3=\text{theta}_1-\text{theta}_2$; and $$1_3=[(\text{theta}_2 r)^2+(h_1+h_2)^2]^{\frac{1}{2}}$$

where $h_1$, $h_2$, $\text{theta}_1$, $\text{theta}_2$, and $\text{theta}_3$ are shown in FIG. 5.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIG. 4*a* illustrates how a bridge can be formed between adjacent perforations in a formation produced by the detonation of shaped charges in a perforating gun; and FIG. 5 illustrates a eased wellbore having three perforations disposed therein produced by the perforating gun of FIGS. 1*a*–1*b*, the three perforations being connected by dotted lines having three sides $1_1$, $1_2$, $1_3$, separated by phase angles $\text{theta}_1$, $\text{theta}_2$, and $\text{theta}_3$, and disposed vertically from one another by a height $h_1$ and $h_2$, the above referenced sides, phase angles, and height parameters being used to implement a method, in accordance with the present invention, for determining a plurality of optimum phasing angles given different lengths of the sides $1_1$, $1_2$, $1_3$, the optimum phasing angles being used by the phased shaped charges for maximizing the distances between adjacent perforations in the formation traversed by the wellbore.

DETAILED DESCRIPTION OF THE PREFERRED EMBODIMENT

Figure 1A:
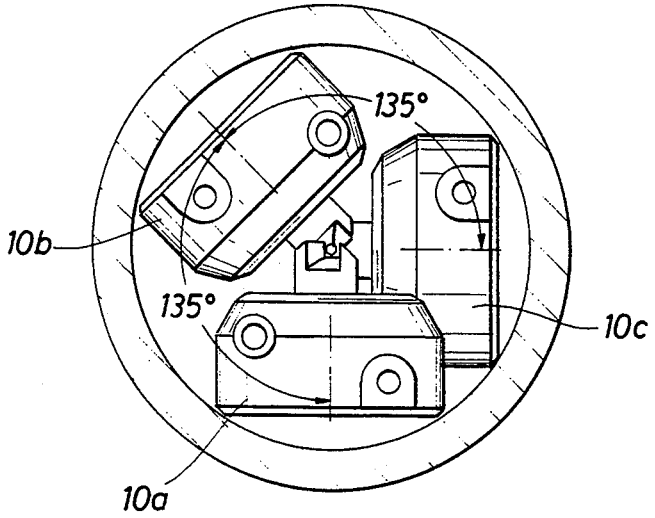
FIG. 1a (PRIOR ART)
FIGS. 1*a*–1*b* illustrate a prior art perforating gun having phased shaped charges.
Figure 1B:
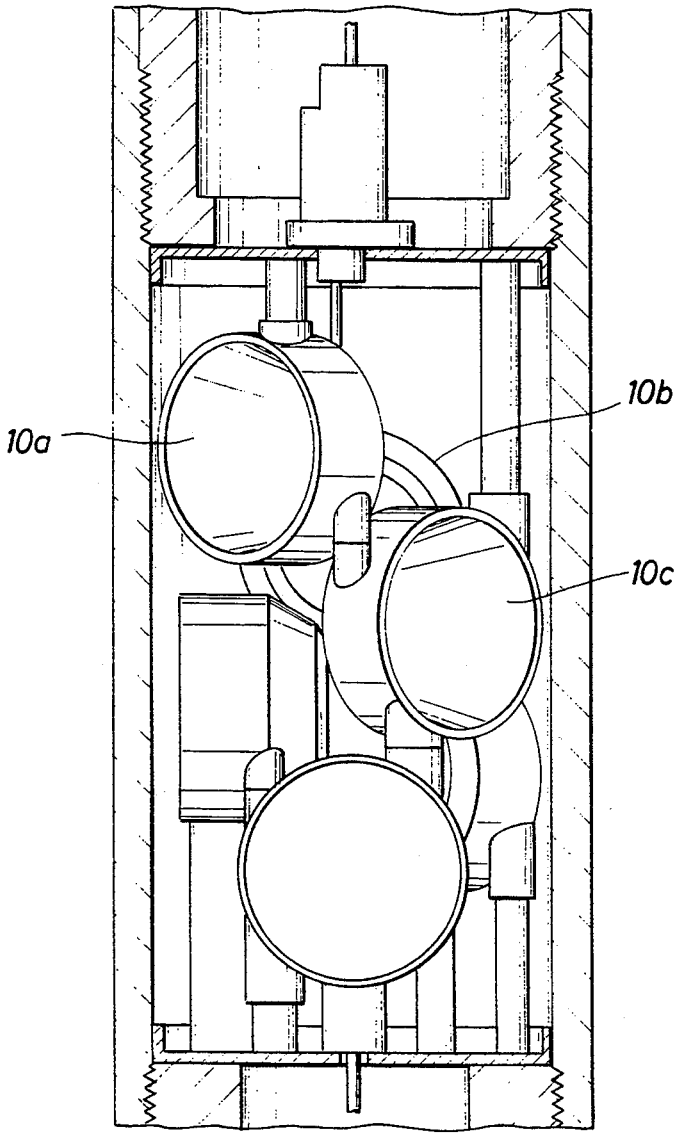
FIG. 1b (PRIOR ART)

Referring to FIGS. 1*a*–1*b*, a perforating gun adapted to be disposed in a wellbore is illustrated as including a plurality of phased shaped charges. In FIG. 1*a*, a first shaped charge 10*a* is disposed at a phase angle of 135 degrees from a second shaped charge 10*b*, and the second shaped charge 10*b* is disposed at a phase angle of 135 degrees from a third shaped charge 10*c*. FIG. 1*b* illustrates these shaped charges 10*a*, 10*b*, and 10*c* in a frontal elevation. When the shaped charges 10*a*–10*c* detonate, they perforate a formation traversed by the wellbore. When a shaped charge perforates the formation, a hole is produced in the formation, and this hole is known as a 'perforation'. Since the shaped charges 10*a*–10*c* may have different phase angles (other than 135 degrees), different patterns of perforations are produced in the formation, each pattern depending upon the shot density in shots per foot along the formation and the phasing of the shaped charges in the perforating gun. Since each formation is usually lined with a cement 'casing', the casing itself will reflect the pattern of perforations produced by the phased shaped charges in the perforating gun.

Referring to FIGS. 2*a*, 2*b*, 3*a*, 3*b*, and 4, different patterns of perforations, produced in the casing, are illustrated.

Figure 2A:
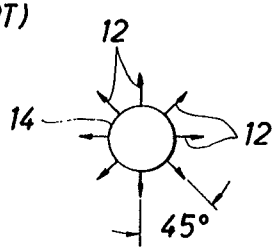
FIG. 2a (PRIOR ART)
Figure 2B:
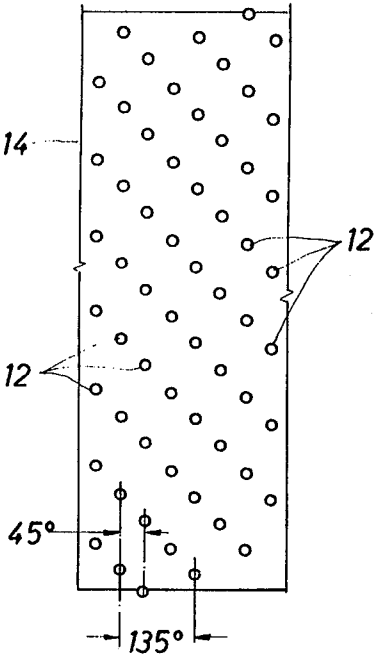
FIG. 2b (PRIOR ART)

For example, FIGS. 2*a*–2*b* illustrate one such pattern of perforations. In FIG. 2*b*, a casing 14 lays fiat on a surface, and a plurality of perforations 12 are disposed through the casing 14. FIG. 2*b* illustrates one pattern of perforations, this pattern being produced by a phase angle of 45 degrees between adjacent shaped charges. FIG. 2*a* illustrates a top view of the casing 14 of FIG. 2*b* when disposed in a wellbore. In FIG. 2*a*, the plurality of perforations 12 are produced by the plurality of shaped charges 10*a*–10*c* in the perforating gun of FIGS. 1*a*–1*b*.

Figure 3A:
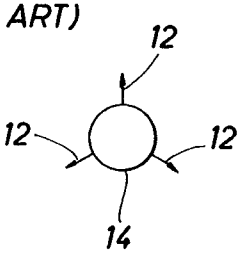
FIG. 3a (PRIOR ART)
Figure 3B:
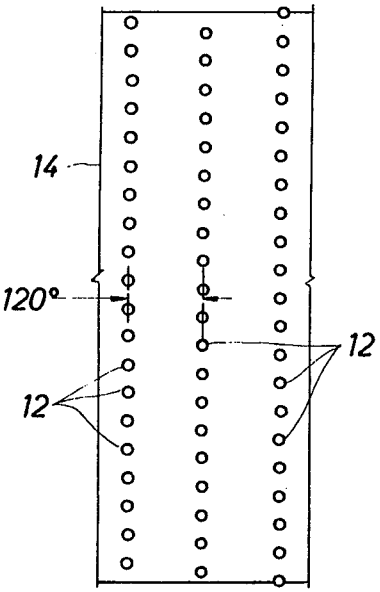
FIG. 3b (PRIOR ART)

FIGS. 3*a*–3*b* illustrate another pattern of perforations disposed through the casing 14 and into a formation traversed by the wellbore. This pattern is produced by a 120 degree phase angle between adjacent shaped charges in the perforating gun of FIGS. 1*a*–1*b*.

Figure 4:
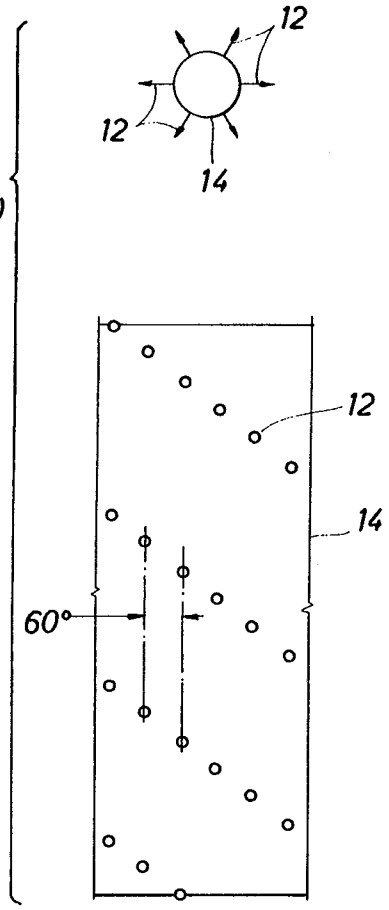
FIG. 4 (PRIOR ART)
FIGS. 2*a*–2*b*, 3*a*–3*b*, and 4 illustrate different prior art patterns of perforations capable of being produced in a cased formation traversed by a wellbore by the phased shaped charges of FIGS. 1*a*–1*b*.

FIG. 4 illustrates still another pattern of perforations 12 disposed through the casing 14 and projecting into the formation traversed by the wellbore, this pattern being produced by a 60 degree phase angle between adjacent charges in the perforating gun of FIGS. 1*a*–1*b*.

FIGS. 1*a* through 4 are shown in U.S. Pat. No. 4,960,171 to Parrott et al, entitled "Charge Phasing Arrangements in a Perforating Gun", the disclosure of which is incorporated by reference into this specification.

Referring to FIG. 4*a*, a pair of perforations 12 are shown disposed in a formation traversed by a cased wellbore 14. A bridge 16 is defined between the two adjacent perforations 12*a*, 12*b* in the formation. If this bridge 16 fails, a flow channel is formed between a first perforation 12*a* and a second adjacent perforation 12*b*, and this flow channel could allow disaggregated sand or other particulates in a first perforation 12*a* to flow into the second perforation 12*b* via the bridge 16. This could result in reduced hydrocarbon production and, potentially, a complete failure of the well. This is not desirable.

Consequently, if the phasing of the shaped charges 10*a*–10*c* of FIGS. 1*a*–1*b* is carefully selected, the distance between perforation 12*a* and perforation 12*b* can be maximized. A larger or maximum distance between perforations 12*a* and 12*b* could prevent the bridge 16 from failing the first place. As a result, the sand from one perforation would not be permitted to flow into another, adjacent perforation. The maximized distance between two adjacent perforations results in a structurally stronger bridge between the perforations, and a stronger bridge will thus be able to support large in situ stresses. This will allow greater depletion of the reservoir with lower reservoir pressure before failure of the bridge.

Referring to FIG. 5, a wellbore having three perforations is illustrated. FIG. 5 assists in an understanding of a new method and apparatus, in accordance with the present invention, for determining how to select an optimum phase angle between the adjacent charges 10*a*–10*c* of FIGS. 1*a*–1*b*; and this optimum phase angle between charges will, when the charges detonate, produce perforations in the formation which have a maximum possible distance between the adjacent perforations. When the maximum possible distance between adjacent perforations is achieved, the liklihood that a bridge 16, between adjacent perforations 12*a* and 12*b*, will fail is substantially reduced.

In FIG. 5, a wall 14 of a wellbore or a casing 14 lining the wellbore wall has been perforated by a perforating gun having phased shaped charges. Three perforations in the formation traversed by the wellbore, produced by the shaped charges, are shown in the casing 14: perforation 1, perforation 2, and perforation 3. Perforation 1 is made by a first shaped charge and is disposed in a selected plane 18. Perforation 2 is made by a second shaped charge which is angularly disposed, by a phase angle 'theta$_1$' in the counterclockwise direction relative to perforation 1. Perforation 2 is the next logical perforation from perforation 1 (elevation-wise) when moving along the wellbore's longitudinal axis relative to perforation 1. Perforation 3 is a nearest neighbor relative to perforation 1. Perforation 3 is the perforation having a minimum angle (theta$_2$) between it and perforation 1.

If a horizontal cross section of the cased wellbore 14 is made, a cross section 18 will be formed. A dotted line connects perforation 1 to perforation 2; a similar line connects perforation 2 to perforation 3; and a similar line connects perforation 3 to perforation 1. Label the dotted line between perforation 1 and perforation 2 "$\mathbf{1}_1$" (also known as "side-1"). Label the dotted line between perforation 2 and perforation 3 "$\mathbf{1}_2$" (also known as "side-2"). Label the dotted line between perforation 3 and perforation 1 "$\mathbf{1}_3$" (also known as "side-3"). Perforation 1 is made in the selected plane of cross section 18. Perforation 2, being the next logical perforation elevation-wise relative to perforation 1, is disposed vertically from cross section 18 by a height $h_1$ and is phased from perforation 1 in the counterclockwise direction by a phase angle "theta$_1$". Perforation 3 is disposed vertically from perforation 2 by a height "$h_2$", is disposed vertically from cross section 18 by a height "$h_1+h_2$", and is phased from perforation 1 by a phase angle "theta$_2$", the phase angle "theta$_2$" being the smallest angle between perforation 3 and perforation 1. Therefore, the included phase angle between perforation 2 and perforation 3 in cross section 18 is "theta$_3$", where theta$_3$=-theta$_1$−theta$_2$.

Recall that the primary objective of the present invention is to determine the optimum phasing for the shaped charges 10*a*–10*c*, for a given wellbore radius, shot density in shots per foot, and perhaps perforating gun size, which would maximize the distances between adjacent perforations. In FIG. 5, the distance between adjacent perforations is denoted by the dotted lines connecting the adjacent perforations labelled "$\mathbf{1}_1$", "$\mathbf{1}_2$", and "$\mathbf{1}_3$".

Accordingly, the method, in accordance with the present invention, for determining the optimum phasing or phase angle between adjacent shaped charges 10*a*–10*c* in a perforating gun is as follows:

1. First, select two parameters: the wellbore radius (r) and the shot density in shots/foot. The shot density relates to the number of perforations desired for each foot of depth in the wellbore (in units of shots/foot).

2. From the wellbore radius (r) and shot density parameters, select various values of the phase angle "theta$_1$". When the phase angle "theta$_1$" is determined, consult FIG. 5, select a phase angle "theta$_2$", and determine a phase angle "theta$_3$". The phase angle "theta$_3$" is determined from the following equation: theta$_3$=-theta$_1$−theta$_2$. When consulting FIG. 5, determine the height data "$h_1$" and "$h_2$".

3. Mathematical formulation equations are set forth below. In the following mathematical formulations, the length data ($\mathbf{1}_1$, $\mathbf{1}_2$, and $\mathbf{1}_3$) are a function of the previously determined phase angles (theta$_1$, theta$_2$, and theta$_3$), wellbore radius (r), and height data ($h_1$ and $h_2$). Accordingly, use the following mathematical formulation equations to calculate the length data ($\mathbf{1}_1$, $\mathbf{1}_2$, and $\mathbf{1}_3$) from the previously determined phase angles (theta$_1$, theta$_2$, and theta$_3$), wellbore radius (r), and height data ($h_1$ and $h_2$):

$$l_1=[(\text{theta}_1 r)^2+h_1^2]^{\frac{1}{2}}$$

$$l_2=[(\text{theta}_3 r)^2+h_2^2]^{\frac{1}{2}},$$

where theta$_3$=theta$_1$−theta$_2$; and $$l_3=[(\text{theta}_2 r)^2+(h_1+h_2)^2]^{\frac{1}{2}}$$

The length data "$\mathbf{1}_1$", "$\mathbf{1}_2$", and "$\mathbf{1}_3$", for each value of the phase angle "theta$_1$", is now determined.

Accordingly, TABLE I, set forth below, lists the length data "$\mathbf{1}_1$", "$\mathbf{1}_2$", and "$\mathbf{1}_3$" for each of the previously determined values of the phase angle "theta$_1$", shot density, and wellbore radius:

TABLE I

| | wellbore radius 4.25" | | | |
|---|---|---|---|---|
| shot density | Phase Angle (theta$_1$) | length $l_1$ | length $l_2$ | length $l_3$ |
| 12 spf | 138 | 10.28 | 6.54 | 5.0 |
| 12 spf | 140 | 10.43 | 6.26 | 5.37 |
| 12 spf | 142.75 | 10.63 | 5.87 | 5.88 |
| 12 spt | 144 | 10.72 | 5.7 | 6.12 |
| 12 spf | 146 | 10.87 | 5.42 | 6.51 |

4. Determine the "optimum phase angle". To determine the optimum phase angle, analyze the length data $\mathbf{1}_1$, $\mathbf{1}_2$, and $\mathbf{1}_3$ in each line of TABLE II. For each line of TABLE II, determine which lines satisfy the following "distance maximization algorithm": two of the lengths (e.g.-$\mathbf{1}_2$ and $\mathbf{1}_3$) are approximately equal to each other and the third length (e.g.-$\mathbf{1}_1$) is greater than either of the other two lengths (e.g.-$\mathbf{1}_2$ and $\mathbf{1}_3$). The phase angle associated with the line of TABLE I which satisfies the "distance maximization algorithm" is defined to be the "optimum phase angle". In TABLE I, the third line satisfies the 'distance maximization algorithm', the third line being duplicated as follows:

| shot density | Phase Angle ($theta_1$) | length $l_1$ | length $l_2$ | length $l_3$ |
|---|---|---|---|---|
| 12 spf | 142.75 | 10.63 | 5.87 | 5.88 |

Note that $l_2 = 5.87$, $l_3 = 5.88$, and $l_1 = 10.63$. Therefore, $l_2$ is approximately equal to $l_3$; $l_1$ is greater than $l_2$, and $l_1$ is greater than $l_3$. The phase angle for this line is 142.75 degrees.

Therefore, phase angle "142.75" is defined to be the "optimum phase angle" for a wellbore radius of 4.25 inches and a shot density of 12 shots per foot. If all of the shaped charges 10*a*–10*c* of the perforating gun of FIGS. 1*a*–1*b* are phased at the optimum phase angle of 142.75, the distances between the perforations in the formation produced by such shaped charges will be maximized, and the liklihood that the bridge (such as bridge 16 of FIG. 4*a*) between adjacent perforations will fail (as a result of the rock between the perforations failing) is substantially reduced.

In TABLE I, although the third line set forth above clearly satisfies the distance maximuzation algorithm, the second line of TABLE I also satisfies the distance maximization algorithm, as follows:

| shot density | Phase Angle ($theta_1$) | length $l_1$ | length $l_2$ | length $l_3$ |
|---|---|---|---|---|
| 12 spf | 140 | 10.43 | 6.26 | 5.37 |

Note that $l_2 = 6.26$, $l_3 = 5.37$, and $l_1 = 10.43$. The length $l_2$ is close enough to the length $l_3$ to say that $l_2$ is approximately equal to $l_3$; and since $l_1$ is greater than $l_2$, and $l_1$ is greater than $l_3$, the phase angle of 140 degrees can also be defined to be an "optimum phase angle" for a wellbore radius of 4.25 inches and a shot density of 12 shots per foot.

The apparatus, in accordance with the present invention, is defined to be any perforating apparatus which includes phased shaped charges where such phased shaped charges are phased by a phase angle equal to the 'optimum phase angle', the optimum phase angle being determined by the above referenced method in accordance with the present invention.

Using the above referenced method for determining the optimum phase angle for phasing charges in a perforating gun, the following TABLE II gives the optimum phasing for typical gun/wellbore configurations:

TABLE II

| gun size | SPF | wellbore radius | optimum phasing | $l_1$ | $l_2$ | $l_3$ | minimum % improvement |
|---|---|---|---|---|---|---|---|
| 3 ⅜" | 6 | 3.00" | 133.00 | 7.24 | 6.34 | 6.34 | 70 |
| 3⅜" | 6 | 4.25" | 138.75 | 10.48 | 7.31 | 7.31 | 50 |
| 4½" | 6 | 4.25" | 138.75 | 10.48 | 7.3 | 7.31 | 6 |
| 4½" | 12 | 4.25" | 142.75 | 10.63 | 5.87 | 5.88 | 31 |
| 7" | 12 | 5.75" | 143.25 | 14.40 | 7.64 | 7.61 | 40 |

The phasing does not need to be exactly as shown above. A plus or minus one degree error gives about a 3% reduction in perforation to perforation spacing.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A method of phasing charges in an apparatus adapted to be disposed in a wellbore, comprising the steps of:

(a) selecting three charges, a first charge, a second charge, and a third charge;

(b) determining a perforation in a formation traversed by the wellbore for each of said three charges thereby producing a first perforation, a second perforation, and a third perforation;

(c) determining three phase angles $theta_1$, $theta_2$, and $theta_3$, where $theta_1$ is an angle between the first perforation and the second perforation, $theta_2$ is an angle between the first perforation and the third perforation, and $theta_3$ is an angle between the second perforation and the third perforation;

(d) incorporating said three phase angles into a mathematical formulation thereby determining a line length $\mathbf{1}_1$, a line length of $\mathbf{1}_2$, and a line length of $\mathbf{1}_3$;

(e) when a first one and a second one of the line lengths are approximately equal to each other and a third one of the line lengths are greater than the first and second one of the line lengths, noting an included phase angle disposed between the first perforation and the second perforation, said included phase angle being an optimum phase angle; and (f) phasing said charges in said apparatus at a particular phase angle where said particular phase angle is equal to said optimum phase angle.

2. The method of claim 1, wherein said mathematical formulation comprises three mathematical equations, said equations including, $$1_1=[(theta_1 r)^2+h_1^2]^{\frac{1}{2}},$$

$$1_2=[(theta_3 r)^2+h_2^2]^{\frac{1}{2}},$$

where $theta_3 = theta_1 - theta_2$, and $$1_3=[(theta_2 r)^2+(h_1+h_2)^2]^{\frac{1}{2}}$$

where $theta_1$ is said angle between said first perforation and said second perforation, $theta_2$ is said angle between said first perforation and said third perforation, and $theta_3$ is said angle between said second perforation and said third perforation, r is a radius of said wellbore, $h_1$ is a height along a longitudinal direction in said wellbore between the first perforation and the second perforation, and $h_2$ is the height between the second perforation and the third perforation.

3. The method of claim 1, wherein the noting step (e) further comprises:

(g) forming a table of values having at least four columns, a first column being said line length $\mathbf{1}_1$, a second column being said line length $\mathbf{1}_2$, a third column being said line length $\mathbf{1}_3$, and a fourth column being said angle $theta_1$; and (h) analyzing each line in said table of values.

4. The method of claim 3, wherein the analyzing step (h) comprises the step of:

in a particular line of said table, when a first one and a second one of the line lengths are approximately equal to each other and a third one of the line lengths are greater than the first and second one of the line lengths, noting said angle $theta_1$ in said particular line, said angle $theta_1$ in said particular line of said table being said included angle between the first perforation and the second perforation, said included angle being said optimum phase angle.

5. A perforating apparatus adapted to be disposed in a wellbore, comprising:

a plurality of phased charges, adjacent ones of said charges being phased by an angle equal to an optimum phase angle, said charges adapted for producing a plurality of perforations in a formation traversed by the wellbore, said plurality of perforations including a first perforation, a second perforation, and a third perforation, the first, second, and third perforations adapted to be interconnected at a wall of said wellbore by a first imaginary straight line, a second imaginary straight line, and a third imaginary straight line, the first, second and third imaginary straight lines having line lengths of $l_1$, $l_2$, and $l_3$ respectively, said optimum phase angle being a phase angle between the first perforation and the second perforation when a first one and a second one of said line lengths are approximately equal to each other and a third one of said line lengths is greater than said first one and said second one of said line lengths.

6. The perforating apparatus of claim 5, wherein said line lengths $l_1$, $l_2$, and $l_3$ are determined from the following equations:

$$l_1=[(theta_1 r)^2+h_1^2]^{\frac{1}{2}},$$

$$l_2=[(theta_3 r)^2+h_2^2]^{\frac{1}{2}},$$

where $theta_3=theta_1-theta_2$, and $$l_3=[(theta_2 r)^2(h_1+h_2)^2]^{\frac{1}{2}}$$

where $theta_1$ is a phase angle between said first perforation and said second perforation, $theta_2$ is a phase angle between said first perforation and said third perforation, and $theta_3$ is a phase angle between said second perforation and said third perforation, r is a radius of said wellbore, $h_1$ is a height along a longitudinal direction in said wellbore between the first perforation and the second perforation, and $h_2$ is the height between the second perforation and the third perforation.

7. A method of manufacturing a perforating gun adapted to be disposed in a wellbore, said perforating gun including a plurality of shaped charges, comprising the steps of:

selecting three of said shaped charges, a first charge, a second charge disposed directly adjacent the first charge, and a third charge which is a nearest neighbor relative to the first and second charges;

determining a perforation in a formation traversed by the wellbore for each of said three shaped charges thereby producing a first perforation, a second perforation, and a third perforation;

interconnecting an imaginary straight line at a wall of said wellbore between the first and second perforation, the second and third perforation, and the third and first perforation thereby producing a first imaginary straight line, a second imaginary straight line, and a third imaginary straight line;

assigning a line length of $l_1$ to the first line, a line length of $l_2$ to the second line, and a line length of $l_3$ to the third line;

when a first one and a second one of the line lengths are approximately equal to each other and a third one of the line lengths are greater than the first and second one of the line lengths, noting an included phase angle disposed between the first perforation and the second perforation, an optimum phase angle being equal to said included phase angle; and phasing at least two of said plurality of shaped charges in said perforating gun using a phase angle equal to said optimum phase angle.

8. The method of claim 7, wherein the line length $l_1$, the line length $l_2$, and the line length $l_3$ are determined from the following equations:

$$l_1=[(theta_1 r)^2+h_1^2]^{\frac{1}{2}},$$

$$l_2=[(theta_3 r)^2+h_2^2]^{\frac{1}{2}},$$

where $theta_3=theta_1-theta_2$, and $$l_3=[(theta_2 r)^2(h_1+h_2)^2]^{\frac{1}{2}}$$

where $theta_1$ is a phase angle between said first perforation and said second perforation, $theta_2$ is a phase angle between said first perforation and said third perforation, and $theta_3$ is a phase angle between said second perforation and said third perforation, r is a radius of said wellbore, $h_1$ is a height along a longitudinal direction in said wellbore between the first perforation and the second perforation, and $h_2$ is the height between the second perforation and the third perforation.

9. A method of phasing charges in a perforating gun adapted to be disposed in a wellbore, said charges adapted for producing perforations in a formation traversed by said wellbore, comprising:

determining an optimum phase angle between adjacent ones of said charges in said perforating gun, said optimum phase angle being an angle associated with a maximum distance between the perforations produced by said adjacent ones of said charges; and phasing said adjacent ones of said charges in said perforating gun by an angle equal to said optimum phase angle.

10. The method of claim 9, wherein the determining step comprises the steps of:

selecting three charges in said perforating gun, a first charge, a second charge disposed directly adjacent the first charge, and a third charge which is a nearest neighbor relative to the first and second charges;

detemining a perforation in a formation traversed by the wellbore for each of said three shaped charges thereby producing a first perforation, a second perforation, and a third perforation;

interconnecting an imaginary straight line at a wall of said wellbore between the first and second perforation, the second and third perforation, and the third and first perforation thereby producing a first imaginary straight line, a second imaginary straight line, and a third imaginary straight line;

assigning a line length of $l_1$ to the first line, a line length of $l_2$ to the second line, and a line length of $l_3$ to the third line;

when a first one and a second one of the line lengths are approximately equal to each other and a third one of the line lengths are greater than the first and second one of the line lengths, noting an included phase angle disposed between the first perforation and the second perforation, said included phase angle being said optimum phase angle.

11. The method of claim 10, wherein the line length $l_1$, the line length $l_2$, and the line length $l_3$ are determined from the following equations:

$$l_1=[(\text{theta}_1 r)^2+h_1^2]^{\frac{1}{2}},$$

$$l_2=[(\text{theta}_3 r)^2+h_2^2]^{\frac{1}{2}},$$

where $\text{theta}_3=\text{theta}_1-\text{theta}_2$, and $$l_3=[(\text{theta}_2 r)^2(h_1+h_2)^2]^{\frac{1}{2}}$$

where $\text{theta}_1$ is a phase angle between said first perforation and said second perforation, $\text{theta}_2$ is a phase angle between said first perforation and said third perforation, and $\text{theta}_3$ is a phase angle between said second perforation and said third perforation, r is a radius of said wellbore, $h_1$ is a height along a longitudinal direction in said wellbore between the first perforation and the second perforation, and $h_2$ is the height between the second perforation and the third perforation.

12. An apparatus adapted to be disposed in a wellbore, comprising:

a plurality of phased charges, adjacent ones of said charges being phased by an angle equal to an optimum phase angle, said charges adapted for producing a plurality of perforations in a formation traversed by the wellbore, said plurality of perforations including a first perforation, a second perforation, and a third perforation, the first, second, and third perforations adapted to be interconnected at a wall of said wellbore by a first imaginary straight line, a second imaginary straight line, and a third imaginary straight line, the first, second and third imaginary straight lines having line lengths of $l_1$, $l_2$, and $l_3$ respectively, said optimum phase angle being a phase angle between the first perforation and the second perforation when a first one and a second one of said line lengths are approximately equal to each other and a third one of said line lengths is greater than said first one and said second one of said line lengths.

13. The apparatus of claim 12, wherein said line lengths $l_1$, $l_2$, and $l_3$ are determined from the following equations:

$$l_1=[(\text{theta}_1 r)^2+h_1^2]^{\frac{1}{2}},$$

$$l_2=[(\text{theta}_3 r)^2+h_2^2]^{\frac{1}{2}},$$

where $\text{theta}_3=\text{theta}_1-\text{theta}_2$, and $$l_3=[(\text{theta}_2 r)^2(h_1+h_2)^2]^{\frac{1}{2}}$$

where $\text{theta}_1$ is a phase angle between said first perforation and said second perforation, $\text{theta}_2$ is a phase angle between said first perforation and said third perforation, and $\text{theta}_3$ is a phase angle between said second perforation and said third perforation, r is a radius of said wellbore, $h_1$ is a height along a longitudinal direction in said wellbore between the first perforation and the second perforation, and $h_2$ is the height between the second perforation and the third perforation.

14. A method of phasing objects in a wellbore apparatus adapted to be disposed in a wellbore, said objects adapted for producing perforations in a formation traversed by said wellbore, comprising:

determining an optimum phase angle between adjacent ones of said objects in said wellbore apparatus, said optimum phase angle being an angle associated with a maximum distance between the perforations produced by said adjacent ones of said objects; and phasing said adjacent ones of said objects in said wellbore apparatus by an angle equal to said optimum phase angle.

15. The method of claim 14, wherein the determining step comprises the steps of:

selecting three objects in said wellbore apparatus, a first object, a second object disposed directly adjacent the first object, and a third object which is a nearest neighbor relative to the first and second objects;

determining a perforation in a formation traversed by the wellbore for each of said three objects thereby producing a first perforation, a second perforation, and a third perforation;

interconnecting an imaginary straight line at a wall of said wellbore between the first and second perforation, the second and third perforation, and the third and first perforation thereby producing a first imaginary straight line, a second imaginary straight line, and a third imaginary straight line;

assigning a line length of $l_1$ to the first line, a line length of $l_2$ to the second line, and a line length of $l_3$ to the third line;

when a first one and a second one of the line lengths are approximately equal to each other and a third one of the line lengths are greater than the first and second one of the line lengths, noting an included phase angle disposed between the first perforation and the second perforation, said included phase angle being said optimum phase angle.

16. The method of claim 15, wherein the line length $l_1$, the line length $l_2$, and the line length $l_3$ are determined from the following equations:

$$l_1=[(\text{theta}_1 r)^2+h_1^2]^{\frac{1}{2}},$$

$$l_2=[(\text{theta}_3 r)^2+h_2^2]^{\frac{1}{2}},$$

where $\text{theta}_3=\text{theta}_1-\text{theta}_2$, and $$l_3=[(\text{theta}_2 r)^2(h_1+h_2)^2]^{\frac{1}{2}}$$

where $theta_1$ is a phase angle between said first perforation and said second perforation, $theta_2$ is a phase angle between said first perforation and said third perforation, and $theta_3$ is a phase angle between said second perforation and said third perforation, r is a radius of said wellbore, $h_1$ is a height along a longitudinal direction in said wellbore between the first perforation and the second perforation, and $h_2$ is the height between the second perforation and the third perforation.

* * * * *